United States Patent [19]

Shannon et al.

[11] 4,372,284

[45] Feb. 8, 1983

[54] BASEBALL-PITCHING MACHINE

[76] Inventors: James A. Shannon, 1705 W. Hunt; B. W. McClure, 1517 Lakewood, both of Sherman, Tex. 75090

[21] Appl. No.: 139,792

[22] Filed: Apr. 14, 1980

[51] Int. Cl.[3] ..... F41B 11/00

[52] U.S. Cl. ..... 124/78

[58] Field of Search ..... 124/78, 81, 82, 49, 124/41 R; 273/26 D

[56] References Cited

U.S. PATENT DOCUMENTS

| | | | |
|---|---|---|---|
| Re. 28,462 | 7/1975 | Halstead | 124/78 |
| 1,916,253 | 7/1933 | Buckley | 82/1.4 |
| 2,918,915 | 12/1959 | Doeg | 124/50 X |
| 3,785,358 | 1/1974 | D'Angelo et al. | 124/78 |
| 3,811,421 | 5/1974 | Betten | 124/78 |
| 4,026,261 | 5/1977 | Paulson et al. | 124/78 |
| 4,262,648 | 4/1981 | Wegener et al. | 273/26 D |

*Primary Examiner*—Richard C. Pinkham

*Assistant Examiner*—William R. Browne

*Attorney, Agent, or Firm*—Hubbard, Thurman, Turner & Tucker

[57] ABSTRACT

A baseball-pitching machine wherein a baseball is delivered into the constricted space between, and thereby gripped frictionally by, to oppositely rotating wheels which throw the ball. A single DC shunt wound motor is used to drive the wheels in cooperation with one variable drive pulley and an assortment of guide pulleys. One wheel is driven at a constant speed by the motor while the speed of the second wheel is adjusted by means of a variable drive pulley. By thus changing the speed of one of the two oppositely rotating wheels, it is possible to impart a variety of spins to the thrown ball and thus simulate curve and slider balls thrown by a professional pitcher. The axis of the variable drive pulley is fixed and the position of the belt within the variable drive pulley is controlled indirectly by means of a belt tensioning pulley operated by a screw.

11 Claims, 4 Drawing Figures

BASEBALL-PITCHING MACHINE

BACKGROUND OF THE INVENTION

1. Field of the Invention

The present invention relates to a baseball pitching machine, intended for use as a substitute for a human pitcher during baseball batting practice and adapted to pitch both straight and curve balls to a batter so that the ball enters the strike zone at substantially the same spot during each repetition of a series of throws.

2. Description of the Prior Art

There have been many attempts to obtain uniform control of mechanically thrown baseballs. Ball throwing devices employing a swinging arm, a mechanical impact means or spring loaded propelling devices are notorious for instability and inaccuracy. In addition, such machines cannot produce the variety of pitches that a batter is likely to encounter on the playing field.

In recent years, pitching machines have been produced which use two oppositely rotating wheels positioned so that a nip is created into which a baseball may be introduced from one side for projection from the other side. An example of such a machine is that of Doeg (U.S. Pat. No. 3,604,409 issued Sept. 14, 1972). Another example of such a machine is Halstead (U.S. Pat. No. Re. 28,462, reissued July 1, 1975).

The baseballs delivered by a machine such as the Doeg machine and the Halstead machine are not consistently thrown over many repetitions into the same spot or substantially the same spot in the batter's strike zone. The consistency of these machines is adversely affected by the use of a separate motor for each wheel. The inevitable slight perturbation in the speed of an electric motor causes the relative angular velocity of wheels driven by two such motors to vary over an impermissibly wide range. Such variations in relative angular velocity cause the spin imparted to the ball to change at random from one throw to the next. The random nature of such changes makes the strike zone arrival point of the ball quite unpredictable. If the batter cannot relay on the balls arriving at substantially the same spot during a series of ball projections, he is not able to concentrate upon hitting the particular type of pitch for which he is preparing. Improved predictability would be particularly advantageous in the training of younger batters who fear being hit by the ball. The young batter's confidence level is increased in direct proportion to an increase in ball arrival predictability.

Accordingly, it is an object of this invention to provide a baseball pitching machine able to deliver a curve ball into substantially the same spot of the batter's strike zone at each repetition of a series of practice pitches.

Another object is to provide a baseball pitching machine of the counter-rotating wheel pair type in which both wheels are turned by means of one electric motor so that fluctuations in the speed of such is motor damped out or cancelled by the distribution of such fluctuations over both wheels of the pair of counter-rotating wheels.

SUMMARY OF THE INVENTION

The baseball pitching machine of this invention includes two oppositely rotating wheels, the axles of which are held in rotational relationship with a horizontal platform by means of bearings, the axle of one wheel engages a variable drive pulley below the horizontal platform, and a standard pulley on the other axle engages the drive pulley of an electric motor. A double V-belt connects all of the pulleys.

Tension on the V-belt is adjusted by means of a tensioner pulley mounted on a block sliding in a channel and controlled by a crank. As the tension on the V-belt is changed at the tension pulley, the V-belt is caused to move more or less closely to the center of the variable drive pulley.

In operation, the speed of the wheel attached to the variable drive pulley is controlled by turning the crank attached to the sliding block on which the tensioner pulley is mounted.

The motor, wheels, and pulleys of the present invention are mounted in a multi-sectional frame appropriately jointed and with pivots to allow adjustments to be made in the elevation and direction of the path of the projected ball. At the bottom of the frame are roadwheels at one end and a wagontongue at the other to facilitate movement of the machine onto and off of the playing field.

The motor is a DC shunt wound motor which is connected to a standard 60 cycle 120 volt AC power supply through an appropriate rectifier. The field voltage of the motor is controlled by means of a suitable rheostat.

DESCRIPTION OF THE PREFERRED EMBODIMENT

Referring now to the figures wherein numerals designate like parts, a preferred embodiment of the invention will be described in detail.

Figure 1:
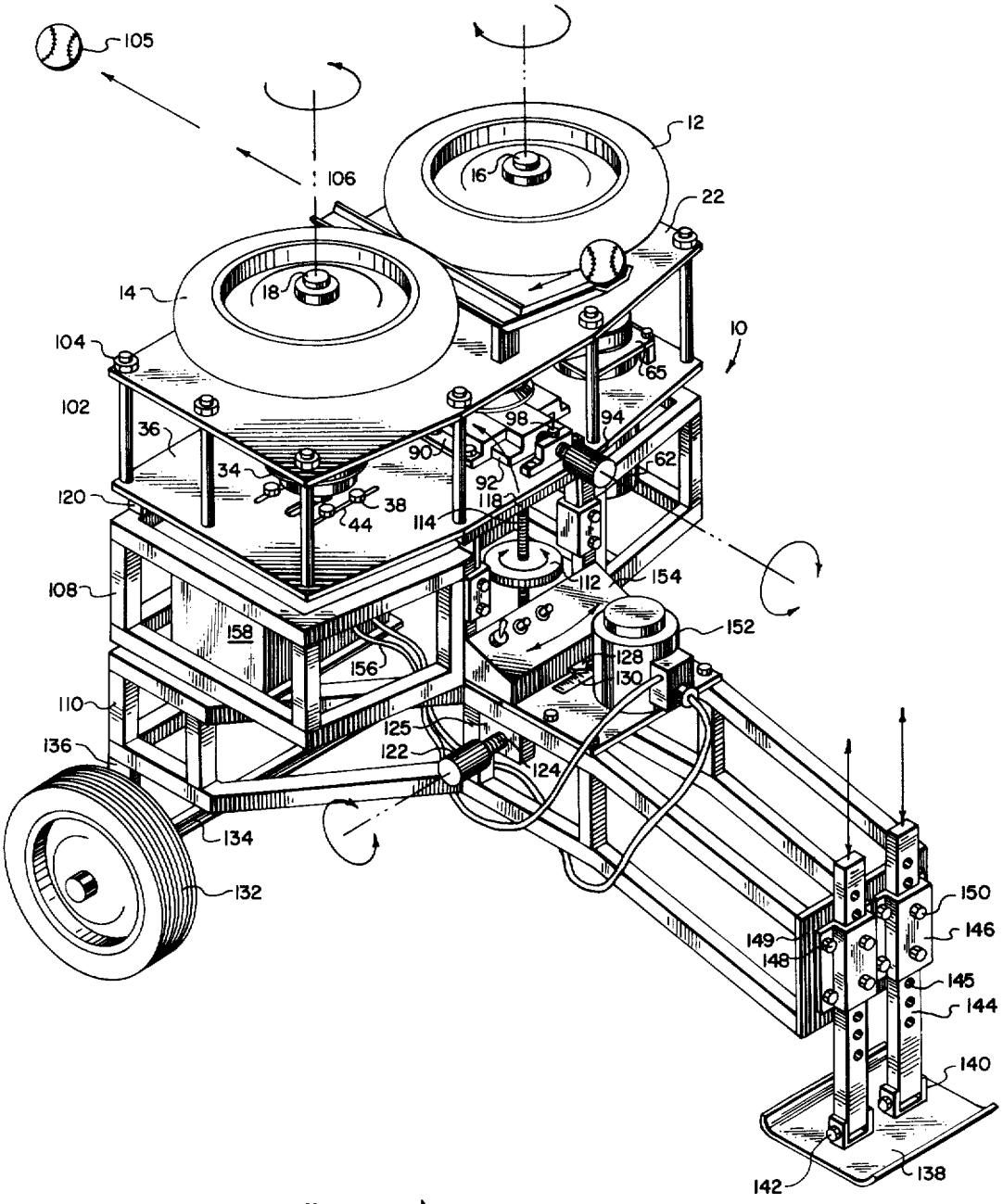
FIG. 1 is a perspective view showing a baseball pitching machine embodying the present invention.

With reference to FIG. 1, one embodiment of a baseball pitching machine is shown wherein oppositely rotating wheels 12 and 14 stand on axes 16 and 18 so that when ball 105 rolls down track 106 it is caught in the nip between wheels 12 and 14 and projected along the path indicated by the arrows. Wheels 12 and 14 are controlled by certain electro-mechanical devices contained between plates 22 and 36 which will be described in detail in conjunction with the explanation of FIG. 4. Plates 22 and 36 are joined together with spacer posts 102 through which pass nut and bolt combinations 104. Thus joined, plates 22 and 36 form a single unitary platform capable of swinging upward around pivot 120. Such upward pivoting is controlled by hand wheel 112 which is affixed to jackscrew 114. The operation of jackscrew 114 will be described in more detail in conjunction with the explanation of FIG. 2. Pivot hinges 120 and jackscrew 114 connect plate 36 with middle frame platform 108. Middle frame 108 sits atop lower Y-shaped frame 110. Middle frame 108 swivels with respect to lower Y-shaped frame 110 under the control of hand wheel 122 connected to jackscrew 124 turning within tapped-block 125. The manner by which middle frame 108 is made to swivel is described in more detail with reference to FIG. 3 below. A bridge rectifier 158 of a conventional design is also mounted on middle frame 108.

Lower Y-shaped frame 110 is connected to ground wheel 132 and axle 134 by means of suspension bar 136. At the end of the Y-shaped frame opposite axle 134 is mounted ground plate 138. Ground plate 138 pivots by means of brackets 140 and pins 142 at the lower end of spacer bars 144. Spacer bars 144 are drilled at selective spacings 145 so that the wagontongue formed by lower Y-shaped frame 110 can be positioned at selective distances above the ground. Such positioning of the wagontongue is accomplished by sliding spacer bars 144 within brackets 146 attached by means of bolts 148 to wagontongue mounting plate 149. Spacings in bar 144 are selected by means of pins 150.

Also mounted on the wagontongue end of lower Y-shaped frame 110 is control rheostat 152, swivel index strip 130, and tapped-block 125.

Swivel index marker 128 is affixed to fuse box 154 which, in turn, is attached to middle frame 108.

Figure 2:
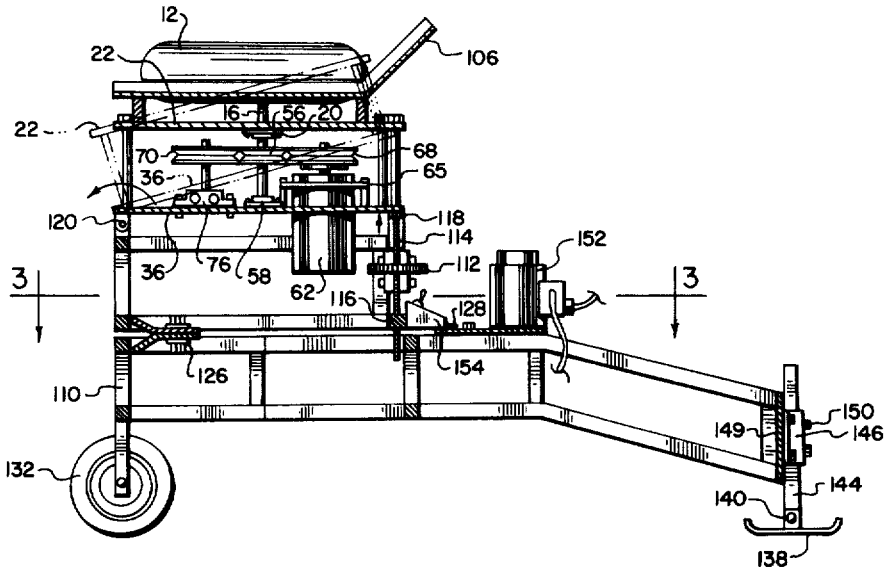
FIG. 2 is a sectional view taken along line 2 showing elevation changing means.

Now referring to FIG. 2, vertical trajectory changing means will be described. Phantom lines in FIG. 2 depict the change in position of plates 36 and 22 made possible by the cooperation of hinge 120 and jackscrew 114. As may be seen by reference to FIG. 2, plate 36 carries motor 62 with its support flange 65 and drive pulley 68. Plate 36 also carries idler pulley 70 mounted on idler pulley block 76. Mounted through plates 22 and 36 is the axle 16 of wheel 12 held in place by bearings 20 and 58. On axle 16 may be seen wheel drive pulley 56. Plate 36 is forced upward against the weight of the aforesaid supported elements by the pressure of jackscrew 114 against foot 118 when turned by handcrank 112 so that jackscrew 114 is driven through tapped-block 116. Such pressure by jackscrew 114 causes plate 136 to pivot on pivot hinge 120. Pivot hinge 120 and tapped-block 116 are both mounted on middle frame 108 as shown in FIG. 2.

Middle frame 108 swivels in relation to lower Y-shaped frame 110 by means of swivel pin 126. The means by which middle frame 108 is swivelled is described in more detail by reference to FIG. 3.

Figure 3:
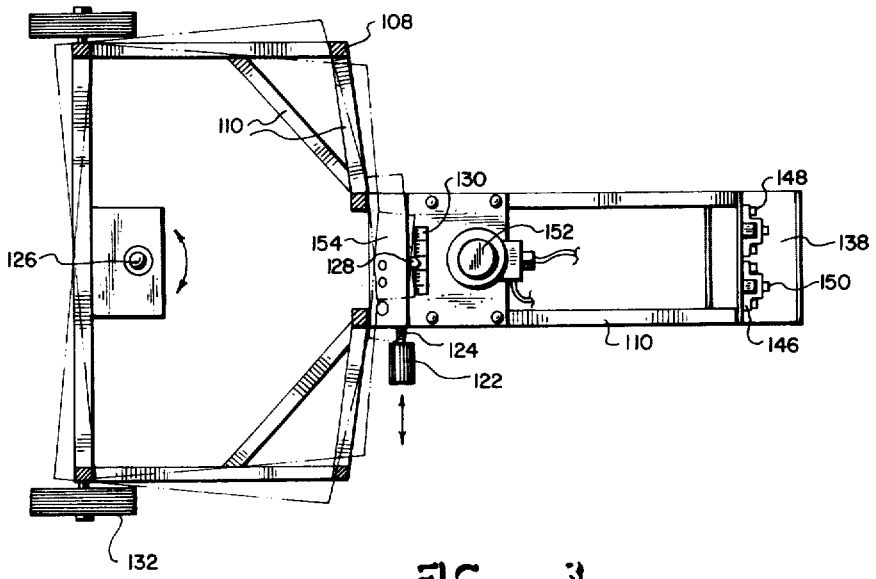
FIG. 3 is a sectional view taken along line 3 showing direction changing means.

Referring now to FIG. 3, the positions which may be assumed by swivelling middle frame 108 are shown in phantom. Swivel pin 126 is shown mounted on lower Y-shaped frame 110. Hand wheel 122 turns jackscrew 124 through tapped-block 125 (not shown). The end of jackscrew 124 opposite hand wheel 122 is nested in swivel foot 123 (not shown). Swivel foot 123 is affixed to middle frame 108 so that when it is pulled towards one side or the other of lower Y-shaped frame 110, middle frame 108 attached to it is made to swivel about swivel pin 126.

Figure 4:
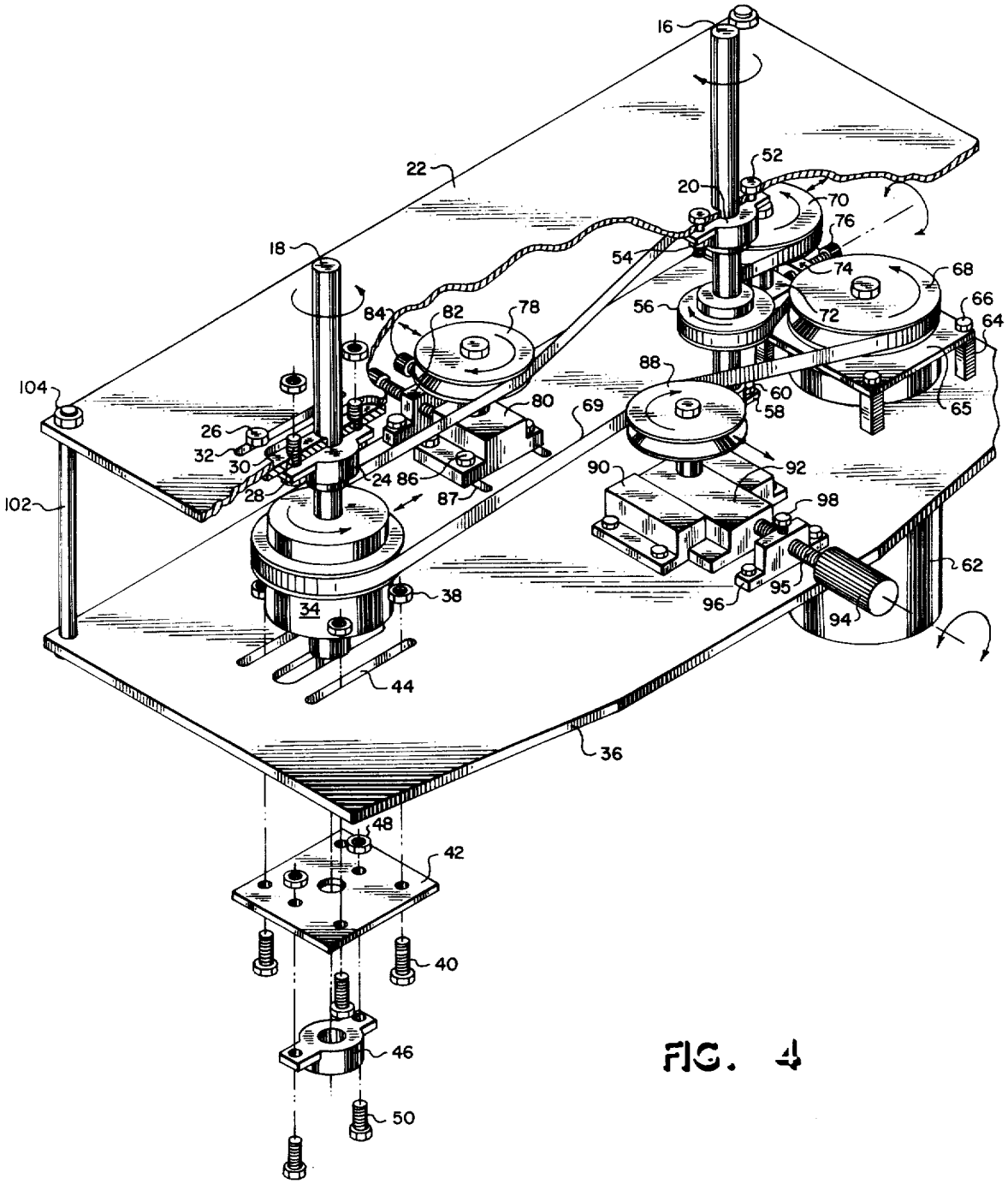
FIG. 4 is an exploded isometric sectional detail of the relative opposite rotational angular velocity changing means.

With reference now to FIG. 4, a means of varying the relative angular velocity of the oppositely rotating wheels is described in detail. FIG. 4 is a detail showing plates 22 and 36 along with associated hardware. Plate 22 is cut away to reveal a system of pulleys. Axle 18 is shown passing through plate 22 and bearing 24. Bearing 24 is held against plate 30 by means of bolts 28. Mounting plate 30 is held against plate 22 by bolts 26. When bolts 26 are loosened, bolts 26 are allowed to slide in slots 32 which have been cut through plate 22. Axle 18 is axially attached to variable drive pulley 34 and passes through variable drive pulley 34 terminating in bearing 46 below plate 36. Bearing 46 is attached to mounting plate 42 by means of nuts 48 and bolts 50. The mounting plate in turn is affixed to the lower side of platform 36 by means of nuts 38 and bolts 40. When nuts 38 are loosened, bolts 40 are free to slide within slots 44 which have been cut into plate 36. This arrangement is the same as that described in conjunction with bearing 24.

Axle 16 passes through plate 22 and bearing 20. Bearing 20 is held against plate 22 by means of nuts 54 and bolts 52. Bearing 58 is attached to plate 36 by bolt 60. Between bearings 58 and 20, axle 16 is attached to wheel drive pulley 56. Motor 62 is secured to plate 36 by bolting its flange 65 between spacer posts 64 and bolts 66 passing through spacer posts 64 and secured to plate 36. Motor 62 turns drive pulley 68. Double V-belt 69 grips drive pulley 68, wheel drive pulley 56, and idler pulley 70. Idler pulley 70 is secured to plate 36 at bearing block 72. Bearing block 72 is drawn towards tapped-block 74 by thumbscrew 76. Double V-belt 69 passes from idler pulley 70 to idler pulley 78. Idler pulley 78 rotates on bearing block 80 which is bolted to plate 36 by means of bolt and nut combination 86. When bolt and nut combination 86 is loosened, bearing block 80 may slide back and forth in slots 87 cut into plate 36. The sliding of bearing block 80 when nut and bolt combination is loosened is controlled by means of tapped-block 82 and thumbscrews 84. Thumbscrews 84 press bearing block 80 so that idler pulley 78 is urged against the tension of double V-belt 69. From idler pulley 78, double V-belt 69 passes around variable drive pulley 34 to idler pulley 88. Idler pulley 88 turns upon bearing block 92. Bearing block 92 slides within a channel created by U-shaped block 90 bolted to plate 36. The channel formed by retainer block 90 is substantially in the shape of an inverted Y. Bearing block 92 is machined to conform to the channel of retainer block 90. The position of bearing block 92 within its channel is controlled by means of hand wheel 94 turning jackscrew 95 through tapped-block 96 and terminating at a foot machined into bearing block 92. Setscrew 98 may be tightened to prevent slippage in jackscrew 95.

In operation, drive pulley 68 turns in a counter-clockwise direction while pulley 56 turns in a clockwise direction. Idler pulley 70 turns in a counter-clockwise direction while idler pulley 78 turns in a clockwise direction. Variable drive pulley 34 turns in a counter-clockwise direction and idler pulley 88 turns in a clockwise direction. Force is transmitted from motor drive pulley 68 to pulley 56, 70, 78, 34, and 88 by means of a double faced V-belt. Idler pulley 88 in cooperation with jackscrew 95 functions as a means of changing the rotational speed of axle 18. As idler pulley 88 is forced against the tension of double faced V-belt 69 by operation of hand wheel 94, the tension of double faced V-belt 69 is increased causing a change in the spacing of spring-loaded variable speed pulley 34. As the tension of double faced V-belt 69 and the biasing of spring-loaded variable drive pulley 34 counteract each other, an equilibrium is reached. The new equilibrium will correspond to a position of the double faced V-belt 69 which is closer to axle 18 causing axle 18 to turn faster in a counter-clockwise direction. When the pressure of idler pulley 88 against double faced V-belt 69 is eased by counter-clockwise rotation of hand wheel 94, the tension on double faced V-belt 69 is relaxed. A relaxation of tension in double faced V-belt 69 enables spring-loaded variable drive pulley 34 to force double faced V-belt 69 away from axle 18 with a consequent slowing of the counter-clockwise rotational speed of axle 18.

Motor 62 is a one-third horsepower DC variable speed motor. One hundred and twenty volt AC current is received and rectified by conventional circuitry contained in box 158 of FIG. 1. DC current is then applied to rheostat 152 where an appropriate DC voltage is selected. The voltage at rheostat 152 is selected to correspond to a desired forward ball speed. Hand wheel 94 is then adjusted to select the desired difference in RPMs between wheel 12 and wheel 14. It is this difference in RPMs which imparts the spin to the baseball. By adjusting the RPM difference by means of hand wheel 94, various types of curve, slider, and knuckleballs are projected by the machine. When the desired ball behavior has been attained, setscrew 98 is tightened against further rotation of hand wheel 94. The machine will now deliver a baseball to substantially the same spot in the batter's strike zone with a trajectory that is consistent over many repetitions.

In order to accommodate batters of differing heights and in order to change the strike zone entry point without altering the spin behavior of the ball, hand wheels 112 and 122 may be adjusted as appropriate.

While a variety of pulleys may be used in conjunction with this invention, the present embodiment employs a Wood's FHP spring-loaded sheave number 6600 having a height of three and seven-eighths inches and diameter of six inches for variable drive pulley 34. In the present embodiment, idler pulleys 70, 78, and 88 are Fafnir brand pulleys number 010-10874 of diameter four inches and width seven-eighths of an inch. Bearings 24 and 20 are Fafnir brand bearing number RA100RRB having a height of 1.343 inches and an outer bore edge diameter of one and one-half inches.

The machine of the present invention can be fully calibrated after only five ball pitching repetitions. Its shunt wound DC motor is especially appropriate due to its constant speed characteristics.

Although a preferred embodiment of the invention has been described in detail, it is to be understood that various changes and substitutions can be made without departing from the spirit and scope of the invention as defined by the appended claims.

I claim:

1. A baseball pitching machine comprising a single shunt wound DC motor having a V-belt pulley thereon; a single double backed V-belt; a single spring-loaded variable speed drive pulley; a first pneumatic tire wheel axially attached to such variable drive pulley; a second wheel axially mounted on a non-variable drive pulley; said V-belt connecting said variable drive pulley, DC shunt wound motor, and non-variable drive pulley; a system of idler pulleys connected to the V-belt for rotating said variable drive pulley and non-variable drive pulley in opposite directions; means for varying the tension on the V-belt; securing means for securing the variable and non-variable drive pulleys, motor, and idler pulley system, and tension varying means so that said V-belt runs substantially in a single plane; means for securing said first and second pneumatic tires so that their axes of rotation are always perpendicular to the plane of the V-belt; means for tilting the plane of the V-belt while such plane remains in perpendicular relationship with the axes of rotation of said first and second wheels; means for pivoting the plane defined by the axes of rotation of the first and second wheels; means of adjusting the distance between the axes of rotation of the first and second pneumatic tire wheels comprising an upper plate and a lower plate, a slot in the upper plate and a slot in the lower plate, both slots receiving an axle axially attached to said first pneumatic tire wheel, such that the center lines of the slot in the upper plate and the slot in the lower plate lie in the same plane as the axes of rotation of the first pneumatic tire wheel and the second pneumatic tire wheel, and the width of said slot being slightly greater than the diameter of the axle, two narrow slots adjacent and parallel to each said slots on either side of said slots, two bearings positioned axially according to the axis of rotation of said first pneumatic tire wheel and receiving the axle, wherein one of such bearings is fastened to the upper plate at the said slot in that plate and to the lower plate at the said slot in that plate by means of bolts passing through said narrow slots which may be loosened to allow the bearings to be moved along said slot and the bolts along said narrow slots; means for varying the distance between the axes of rotation of the first and second wheels; means for introducing a ball into the space between the first and second wheels along a path perpendicular to the plane defined by the axes of rotation of the first and second wheels; and the distance between the axes of rotation of the first and second wheels being adjusted so that balls of varying sizes are gripped between the first and second wheels briefly before being ejected from such oppositely rotating wheels.

2. A baseball pitching machine comprising a single shunt wound DC motor having a V-belt pulley thereon; a single double backed V-belt; a single spring-loaded variable speed drive pulley; a first pneumatic tire wheel axially attached to such variable drive pulley; a second wheel axially mounted on a non-variable drive pulley; said V-belt connecting said variable drive pulley, DC shunt wound motor, and non-variable drive pulley; a system of idler pulley connected to the V-belt for rotating said variable drive pulley and non-variable drive pulley in opposite directions; means for varying the tension on the V-belt; securing means for securing the variable and non-variable drive pulleys, motor, and idler pulley system, and tension varying means so that said V-belt runs substantially in a single plane; securing means including upper and lower plates spaced apart by means of a plurality of channeled spacer posts, a first axle axially of said first pneumatic tire, a first bearing for securing said first axle axially of said first pneumatic tire wheel to the upper plate, a second bearing for securing said first axle axially of said first pneumatic tire wheel axially to said lower plate, a second axle axially of said second pneumatic tire wheel, a third bearing for securing said second axle axially of said second pneumatic tire wheel to said upper plate, a fourth bearing for securing said second axle axially of said second pneumatic tire wheel to said lower plate, a plurality of smaller channeled spacing posts for supporting said motor through and above said lower plate so that the axis of rotation of its V-belt pulley is perpendicular to, and above, the plane of such plate, bearing blocks mounted to said lower plate for securing said idler pulleys thereto; means for tilting the plane of the V-belt while such plane remains in perpendicular relationship with the axes of rotation of said first and second wheels; means for pivoting the plane defined by the axes of rotation of the first and second wheels; means for varying the distance between the axes of rotation of the first and second wheels; means for introducing a ball into the space between the first and second wheels along a path perpendicular to the plane defined by the axes of rotation of the first and second wheels; and the distance between the axes of rotation of the first and second wheels being adjusted so that balls of varying sizes are gripped between the first and second wheels briefly before being ejected from such oppositely rotating wheels.

3. The baseball pitching machine of claim 2 wherein said tilting means comprises at least one hinge attached to said lower plate, a jackscrew abutting against said lower plate at a point opposite said at least one hinge, a hand wheel for turning said jackscrew, a frame below said lower plate, said frame attached to said at least one hinge, a nut on said jackscrew, said nut fixedly attached to said frame wherein the counter-clockwise rotation of said hand wheel forces said jackscrew upward through said nut against its point of abuttment with said lower plate so that said lower plate pivots about said at least one hinge.

4. The baseball pitching machine of claim 3 wherein said means of pivoting the plane defined by the axes of rotation of said first pneumatic tire wheel and said second pneumatic tire wheel includes a platform, a swivel pin on said platform perpendicular to the upper surface of said platform, a means of attaching said frame and said swivel pin, a jackscrew in the same plane as the platform but perpendicular to a line passing through the swivel pin and along the length of said platform, a foot attached to said frame, said foot receiving within a rim a ridge at the end of said jackscrew, a nut with plane perpendicular to the axis of rotation of said jackscrew, said jackscrew passing through said nut, a hand wheel for rotating said jackscrew, so that when said hand wheel is rotated in a clockwise direction said frame pivots about said pivot pin in a clockwise direction.

5. The baseball pitching machine of claim 4 wherein said platform is a Y-shaped structure forming a wagon-tongue, wherein an end plate is affixed to the end of the wagontongue, to which is attached a levelling means.

6. The baseball pitching machine of claim 5 wherein the levelling means includes at least one bracket sleeve mounted on such end plate, at least one arm sliding within said at least one sleeve in a direction generally perpendicular to the plane of the Y-shaped structure, a base plate swivelling at the lower end of the at least one arm, and means for adjustably securing the at least one arm within the at least one bracket sleeve.

7. A baseball pitching machine comprising:

a single shunt wound DC motor having a V-belt pulley thereon; a single double backed V-belt; a single spring-loaded variable speed drive pulley; a first pneumatic tire wheel axially attached to said variable speed drive pulley; a second wheel axially mounted on a non-variable drive pulley; said V-belt connecting said variable speed drive pulley, said motor, and said non-variable drive pulley; a system of idler pulleys connected to said V-belt for rotating said variable speed drive pulley and non-variable drive pulley in opposite directions; securing means for securing said variable speed and non-variable drive pulleys, said motor, and said idler pulley system; means for varying the tension on said V-belt comprising an idler pulley mounted on an inverted Y-shaped bearing block, said bearing block being slidable within a Y-shaped channel formed within the plane of a U-shaped retainer block attached to said securing means, the position of said bearing block longitudinal of said channel being controlled by at least one tapped block through which a jackscrew extends along a line longitudinal to and centered within said channel, a hand wheel axially attached to a first end of said jackscrew, a second end of said jackscrew abutting against said bearing block whereby tension on said V-belt may be increased by forcing said idler pulley mounted on said bearing block against said V-belt in response to turning said jackscrew in a clockwise direction within said one tapped block, and a setscrew received by said one tapped block in perpendicular contact with said jackscrew for locking said jackscrew in a selected position, said tension varying means being arranged so that said V-belt runs substantially in a single plane; means for securing said first and second wheels so that their axes of rotation are always perpendicular to the plane of said V-belt; means for tilting the plane of said V-belt while such plane remains in perpendicular relationship with the axes of rotation of said first and second wheels; means for pivoting the plane defined by the axes of rotation of the first and second wheels; means for varying the distance between the axes of rotation of said first and second wheels; means for introducing a ball into the space between said first and second wheels along a path perpendicular to the plane defined by the axes of rotation of said first and second wheels; and the distance between the axes of rotation of said first and second wheels being adjustable so that balls of varying sizes are gripped between said first and second wheels briefly before being ejected from said first and second wheels.

8. A baseball pitching machine comprising:

a frame supporting a single variable speed drive motor having a belt drive pulley thereon, an endless flexible drive belt, a single variable speed drive pulley, a first pneumatic tired wheel drivably connected to said variable speed drive pulley, and a second pneumatic tired wheel drivably connected to a fixed drive pulley, said belt drivably interconnecting said variable speed drive pulley, said motor, and said fixed drive pulley for rotating said variable speed drive pulley and fixed drive pulley in opposite directions; means for varying the tension on said belt comprising an idler pulley mounted on a bearing block, said bearing block being slidable within a channel formed by a retainer block attached to said frame, the position of said bearing block being controlled by a jackscrew mounted on said frame and abutting against said bearing block whereby tension on said belt may be increased by forcing said idler pulley against said belt in response to turning said jackscrew, and means for locking said jackscrew in a selected position; means for securing said first and second wheels on said frame so that their axes of rotation are generally perpendicular to the plane of said belt; means for tilting the plane of rotation of said wheels; means for pivoting the plane defined by the axes of rotation of said wheels; means for varying the distance between the axes of rotation of said wheels; and means for introducing a ball into a space between said wheels along a path intersecting said plane defined by the axes of rotation of said wheels so that said ball is gripped between said wheels briefly before being ejected from said machine.

9. A baseball pitching machine comprising:

a frame including means for supporting first and second ball propelling wheels spaced apart on said frame for rotation in opposite directions and forming a space between each other into which baseball may be introduced for engagement by said wheels to be ejected from said machine along a predetermined trajectory, said means for supporting said wheels including first and second rotatable axles rotatably mounted on said machine and drivably supporting said first and second wheels, respectively;

drive means for rotating said wheels in opposite directions with respect to each other and at a variable speed of said first wheel with respect to said second wheel, said drive means comprising a variable speed drive pulley connected to said first axle and a first fixed drive pulley connected to said second axle, a variable speed drive motor including a second fixed drive pulley connected to said motor, endless belt means drivably engaged with said variable speed pulley and said first and second fixed pulleys, and a first idler pulley rotatably mounted on said frame and engageable with said belt means; and means for moving said first idler pulley with respect to said belt means for selectively adjusting the tension in said belt means to cause said belt means to engage said variable speed drive pulley at a varying diameter of said variable speed drive pulley in accordance with the tension in said belt means so as to vary the rotational speed of said first wheel with respect to said second wheel for a given speed of said drive motor.

10. A baseball pitching machine comprising:

a frame including means for supporting first and second ball propelling wheels spaced apart on said frame for rotation in opposite directions and forming a space between each other into which a baseball may be introduced for engagement by said wheels to be ejected from said machine along a predetermined trajectory, said means for supporting said wheels including first and second rotatable axles rotatably mounted on said machine and drivably supporting said first and second wheels, respectively;

drive means for rotating said wheels in opposite directions with respect to each other and at a variable speed of said first wheel with respect to said second wheel, said drive means comprising a variable speed drive pulley connected to said first axle and a first fixed drive pulley connected to said second axle, a variable speed drive motor including a second fixed drive pulley connected to said motor, an endless double faced V-belt drivably engaged with said variable speed pulley, and a third fixed pulley mounted such that one face of said belt is trained around and engageable with said variable speed drive pulley and said second and third fixed drive pulleys, and the opposite face of said belt is engageable with said first fixed drive pulley for driving said wheels in opposite directions;

a first idler pulley rotatably mounted on said frame and engageable with said belt; and means for moving said first idler pulley with respect to said belt for selectively adjusting the tension in said belt to cause said belt to engage said variable speed drive pulley at a varying diameter of said variable speed drive pulley in accordance with the tension in said belt so as to vary the rotational speed of said first wheel with respect to said second wheel for a given speed of said drive motor.

11. The pitching machine set forth in claim 10 together with:

a second idler pulley mounted on said frame and including means for moving said second idler pulley with respect to said belt to engage said belt for adjusting the tension in said belt, said second idler pulley being located on said frame along a run of said belt opposite the run of said belt which is engaged by said first idler pulley.

* * * * *